US007396190B2

(12) United States Patent
Price

(10) Patent No.: US 7,396,190 B2
(45) Date of Patent: Jul. 8, 2008

(54) EXTENDED WIDTH RETAINING WALL BLOCK

(75) Inventor: Brian A. Price, Rochester, MN (US)

(73) Assignee: Mortarless Technologies, LLC, Rochester, MN (US)

( * ) Notice: Subject to any disclaimer, the term of this patent is extended or adjusted under 35 U.S.C. 154(b) by 0 days.

(21) Appl. No.: 11/712,104

(22) Filed: Feb. 28, 2007

(65) Prior Publication Data

US 2007/0144099 A1 Jun. 28, 2007

(51) Int. Cl.
*E02D 29/02* (2006.01)
*E04C 2/04* (2006.01)

(52) U.S. Cl. ..... 405/284; 405/286; 52/604; 52/606; 52/608

(58) Field of Classification Search ..... 405/284, 405/286; 52/598, 599, 603–606, 608, 609
See application file for complete search history.

(56) References Cited

U.S. PATENT DOCUMENTS

| | | | | |
|---|---|---|---|---|
| 751,346 | A | 2/1904 | Schall | |
| 1,260,024 | A | 3/1918 | Parton | |
| 1,526,730 | A | 2/1925 | Zottoli | |
| 1,727,362 | A | 9/1929 | Bone | |
| 1,762,343 | A | 6/1930 | Munster | |
| 1,795,451 | A | 3/1931 | Sharpe | |
| 1,816,816 | A | 8/1931 | Sentrop | |
| 3,686,873 | A | 8/1972 | Vidal | |
| 4,068,482 | A | 1/1978 | Hilfiker | |
| 4,123,881 | A | 11/1978 | Muse | |
| 4,154,554 | A | 5/1979 | Hilfiker | |
| 4,207,718 | A | 6/1980 | Schaaf et al. | |
| 4,266,890 | A | 5/1981 | Hilfiker | |
| 4,324,508 | A | 4/1982 | Hilfiker et al. | |
| 4,343,572 | A | 8/1982 | Hilfiker | |
| 4,391,557 | A | 7/1983 | Hilfiker et al. | |
| 4,470,728 | A | 9/1984 | Broadbent | |
| 4,592,678 | A | 6/1986 | McNinch, Jr. et al. | |
| 4,802,320 | A * | 2/1989 | Forsberg | 52/585.1 |
| 4,909,010 | A | 3/1990 | Gravier | |
| 4,914,876 | A | 4/1990 | Forsberg | |
| 4,920,712 | A | 5/1990 | Dean, Jr. | |
| 4,968,186 | A | 11/1990 | Ogorchock | |

(Continued)

OTHER PUBLICATIONS

Brochure, Keysystem 1, Retaining Wall System, copyrighted 2000, pp. 1-8.

(Continued)

*Primary Examiner*—Tara L. Mayo
(74) *Attorney, Agent, or Firm*—Patterson, Thuente, Skaar & Christensen, P.A.

(57) ABSTRACT

A retaining wall block having a front surface, a rear surface, side surfaces, a top surface, and a bottom surface. Each side surface comprises a first section, a second section, a third section, and a fourth section, with the sections configured and arranged to allow a plurality of blocks to be arranged in a convex wall structure. The retaining wall block includes a projection that is configured to abuttingly engage a portion of a vertically adjacent block in a wall structure. Preferably, the block has a width/depth ratio in the range of about 1.87 to 2.67. The retaining wall block may be combined with an earth anchor for use in multi-course walls.

20 Claims, 16 Drawing Sheets

U.S. PATENT DOCUMENTS

| | | | | |
|---|---|---|---|---|
| D317,048 | S | 5/1991 | Forsberg | |
| 5,044,834 | A | 9/1991 | Janopaul, Jr. | |
| 5,046,898 | A | 9/1991 | McKinney | |
| 5,064,313 | A | 11/1991 | Risi et al. | |
| 5,145,288 | A | 9/1992 | Borcherdt | |
| 5,163,261 | A | 11/1992 | O'Neill | |
| RE34,314 | E * | 7/1993 | Forsberg | 52/562 |
| 5,259,704 | A | 11/1993 | Orgorchock | |
| 5,337,527 | A | 8/1994 | Wagenaar | |
| 5,451,120 | A | 9/1995 | Martinez-Gonzalez | |
| 5,456,554 | A | 10/1995 | Barrett et al. | |
| 5,474,405 | A | 12/1995 | Anderson et al. | |
| 5,484,235 | A | 1/1996 | Hilfiker et al. | |
| 5,505,034 | A | 4/1996 | Dueck | |
| 5,511,910 | A | 4/1996 | Scales | |
| 5,525,015 | A | 6/1996 | Morimoto et al. | |
| 5,540,525 | A | 7/1996 | Miller et al. | |
| 5,551,809 | A | 9/1996 | Forsberg | |
| 5,622,456 | A | 4/1997 | Risi et al. | |
| 5,647,185 | A | 7/1997 | Forlini | |
| 5,653,558 | A | 8/1997 | Price | |
| 5,673,530 | A | 10/1997 | Bailey, II | |
| 5,704,183 | A | 1/1998 | Woolford | |
| 5,800,095 | A | 9/1998 | Egan | |
| 5,816,749 | A | 10/1998 | Bailey, II | |
| 5,823,709 | A | 10/1998 | Maher et al. | |
| 5,827,015 | A | 10/1998 | Woolford et al. | |
| D403,437 | S | 12/1998 | Rise et al. | |
| D405,193 | S | 2/1999 | Scales | |
| D405,543 | S | 2/1999 | Shillingburg | |
| 5,913,790 | A | 6/1999 | Dawson | |
| 5,951,210 | A | 9/1999 | Maguire et al. | |
| 6,086,288 | A | 7/2000 | Ruel et al. | |
| 6,113,318 | A | 9/2000 | Guth | |
| 6,168,353 | B1 | 1/2001 | Price | |
| RE37,278 | E | 7/2001 | Forsberg | |
| 6,287,054 | B1 | 9/2001 | Egan | |
| 6,336,773 | B1 | 1/2002 | Anderson et al. | |
| D459,487 | S | 6/2002 | Bott | |
| D466,229 | S | 11/2002 | Risi et al. | |
| 6,474,036 | B2 | 11/2002 | Martin et al. | |
| 6,536,994 | B2 | 3/2003 | Race | |
| D479,342 | S | 9/2003 | Dawson | |
| 6,615,651 | B1 | 9/2003 | Barbanti | |
| 6,622,445 | B1 | 9/2003 | Shillingburg et al. | |
| 6,651,401 | B2 | 11/2003 | Price et al. | |
| 6,652,197 | B2 | 11/2003 | Shaw | |
| D485,371 | S | 1/2004 | Burgess et al. | |
| 6,675,547 | B1 | 1/2004 | Golcheh | |
| 6,792,731 | B2 | 9/2004 | Bott et al. | |
| D497,399 | S | 10/2004 | May et al. | |
| 6,808,339 | B2 | 10/2004 | Peterson et al. | |
| 6,821,058 | B1 | 11/2004 | Dawson | |
| D501,935 | S | 2/2005 | Dawson et al. | |
| 7,059,808 | B2 | 6/2006 | Risi | |
| 7,096,635 | B2 | 8/2006 | Price et al. | |
| D530,832 | S | 10/2006 | Rainey | |
| 2002/0187010 | A1 * | 12/2002 | MacDonald et al. | 405/284 |
| 2005/0016106 | A1 | 1/2005 | Dawson et al. | |
| 2006/0101770 | A1 | 5/2006 | Price | |
| 2006/0110222 | A1 | 5/2006 | Price | |
| 2006/0179780 | A1 | 8/2006 | Price | |

OTHER PUBLICATIONS

Case Study, Water Application, Keystone Retaining Wall System, Upper Cumberland River Flood Project, copyrighted 2000, pp. 1-4.

Case Study, Governmental Application, Keystone Retaining Wall System, Port of Seattle Terminal #5 & SW Harbor Reclamation, copyrighted 2000, pp. 1-4.

Keystone, Retaining Wall System, *The First to Last*, copyrighted 1997, pp. 1-19.

"Classic" product literature, Rockwood Retaining Walls, 12 pgs., 1997.

International Search Report.

International Search Report, 2 pages.

Office Action dated Mar. 19, 2007, 18 pages.

Office Action dated Mar. 20, 2007, 16 pages.

* cited by examiner

EXTENDED WIDTH RETAINING WALL BLOCK

This application claims priority from Provisional Application Ser. No. 60/627,360 filed Nov. 12, 2004, Provisional Application Ser. No. 60/669,949 filed Apr. 8, 2005, and Provisional Application Ser. No. 60/669,947 filed Apr. 8, 2005.

FIELD OF THE INVENTION

This invention relates generally to retaining walls. More particularly, the present invention relates to manufactured blocks that are used to construct mortarless retaining walls.

BACKGROUND OF THE INVENTION

Retaining walls can be both functional and decorative and range from small gardening applications to large-scale construction projects. Such walls are typically used to facilitate the formation of horizontal surface areas by providing a generally vertical barrier behind which backfill may be deposited. Such walls can also used reduce erosion and slumping in embankments. Retaining walls can be constructed of a variety of materials having a variety of shapes. Some retaining walls have been constructed from wood timbers, while others have been constructed from rocks such as limestone of fieldstones. Still others have been constructed of manufactured concrete blocks. A drawback to existing concrete retaining wall blocks is that production, shipping, and installation is limited due to their facing-area to block-weight ratio.

SUMMARY OF THE INVENTION

A retaining wall block that may be used with an earth anchor is disclosed.

Generally, the retaining wall block comprises a front surface, a rear surface, side surfaces, a top surface, and a bottom surface. More particularly, each side surface comprises a first section, a second section, a third section, and a fourth section, with the second section forming a shoulder against which a projection of a vertically adjacent block may abut, and with the fourth section configured to allow a plurality of blocks to be arranged in a convex configuration.

In accordance with one aspect of the present invention, the bottom surface is provided with front and rear projections, with the front projection including a contact edge that is configured and arranged to position the block relative to a lower course of blocks when it is placed thereon. The rear projection has dual functions, one of which is to position the block when it is placed on a lower course of blocks that are arranged in a convex course, the other of which is to facilitate stacking on a pallet for shipping.

The above block may be provided with a core hole that extends through the block between the top and bottom surfaces. The core hole reduces the amount of material needed to form the block and greatly reduces the weight thereof, resulting in a block that is easier to manufacture and manipulate.

The above block may be provided with a plurality of core holes that extend through the block between the top and bottom surfaces. The core holes are separated from each other by a web or core support that serves to strengthen the block. Again, the core holes reduce the amount of material needed to form the block and reduce the weight thereof.

Alternatively, the above block may be formed without any core holes between the top and bottom surfaces. This block has greater strength and weight than the previously discussed cored blocks and is particularly suited for use in lower courses and where pressure exerted by backfill is greater than what would normally be expected.

Generally, the aforementioned blocks have substantially the same height, front surface width, and depth, preferably ranging around 4 to 9 inches (10 to 23 cm), 20 to 24 inches (50 to 60 cm), and 8 to 12 inches (20 to 30), respectively, and more preferably around 8 inches (20 cm), 24 inches (60 cm), and 9 inches (23 cm), respectively. The size and location of the shoulder formed by the second sections can vary, and this can change the distance between the third sections of the sides, and the lengths of the third sections from about 1 to 3 inches (2.54 to 8 cm).

In accordance with a further aspect of the invention, the bottom surface of a block is provided with a single projection that is configured and arranged to abut the shoulders of vertically adjacent blocks when a plurality of blocks are arranged to form a multi-course wall structure.

As will be understood, the above retaining wall blocks may be used with earth anchor grids such as geo-grid or steel ladders. The aforementioned embodiments may also be arranged in a plurality of configurations, such as linear and serpentine walls, or enclosures.

In an alternative embodiment, a retaining wall block of the present invention comprises a generally planar bottom surface and a top surface that is provided with an upwardly extending projection, with the projection configured and arranged engage to the front surface of a vertically adjacent block as the vertically adjacent block is placed thereupon and slid forward.

This embodiment may be provided with a plurality of core holes that extend through the block between the top and bottom surfaces, with the core holes separated from each other by a web or stem that serves to strengthen the block.

The above alternative embodiment retaining wall blocks may be used with earth anchors such as metal grids or lattices, and plastic grids or lattices such as geo-grid.

And, while it is possible to merely position a portion of an earth anchor between adjacent courses of blocks and rely on the weight of the blocks and frictional forces to maintain the positioning of the blocks relative to the earth anchor, it is preferred to operatively connect the blocks to an earth anchor using one or more clips.

In yet another alternative embodiment, a retaining wall block of the present invention comprises a downwardly depending projection that is configured and arranged so that when the block is placed on the top surface of a block therebelow and slid forward, the projection of the upper block engages a rearwardly facing surface of the block therebelow, and the upper block is prevented from moving further forward.

As with the previously described embodiment, this embodiment may be provided with a plurality of core holes that extend through the block between the top and bottom surfaces, with the core holes separated from each other by a web or stem that serves to strengthen the block.

The above alternative embodiment retaining wall blocks may be used with earth anchors such as metal grids or lattices, and plastic grids or lattices such as geo-grid.

And, while it is possible to merely position a portion of an earth anchor between adjacent courses of blocks and rely on the weight of the blocks and frictional forces to maintain the positioning of the blocks relative to the earth anchor, it is preferred to operatively connect the blocks to an earth anchor using one or more attachment bars.

As will be appreciated that the front surfaces of the aforementioned embodiments may be provided with decorative and/or aesthetic finishes. For example, the front surfaces may be planar, angular, prismatic, or curvilinear, and have a wide variety of finishes. In addition, the front surface of a single block may be provided with alpha-numeric characters, or with simulative decorative characters or objects in bas or alto relief.

Additional advantages and features of the invention will appear more fully from the following description, made in conjunction with the accompanying drawings wherein like reference characters refer to the same or similar parts throughout the several views.

DETAILED DESCRIPTION

Figure 1:
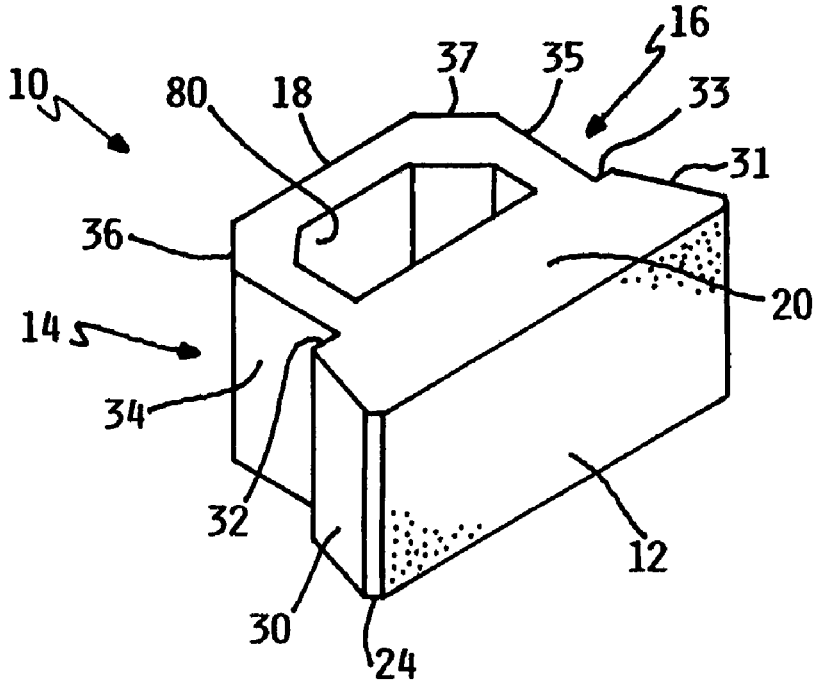
FIG. 1 is a perspective view of a preferred embodiment of a block of the present invention, looking down to reveal the details of the top and front surfaces.
Figure 2:
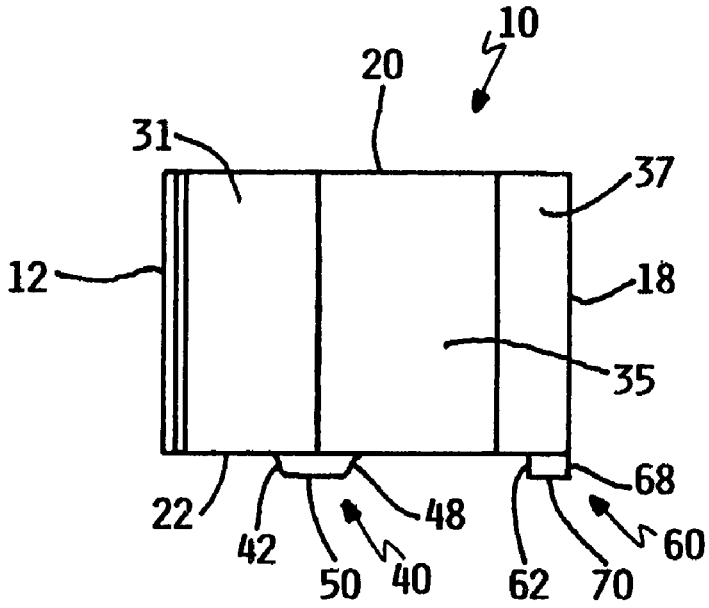
FIG. 2 is a side elevational view of the block of FIG. 1.
Figure 3:
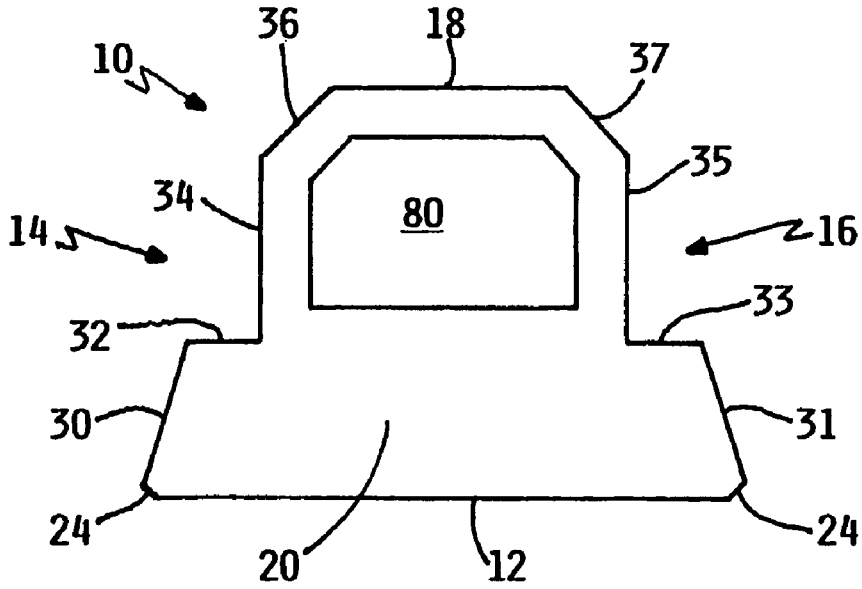
FIG. 3 is a top plan view of the block of FIG. 1.
Figure 4:
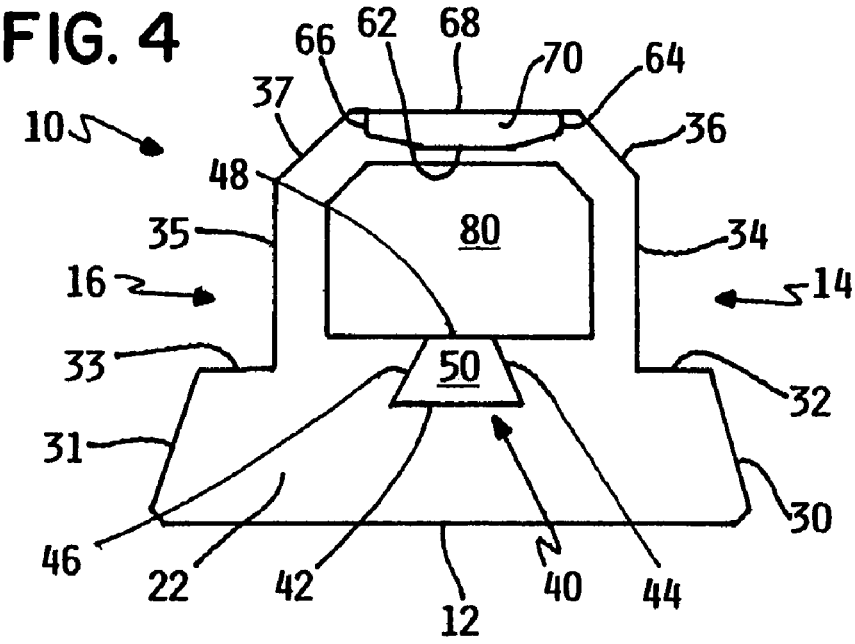
FIG. 4 is a bottom plan view of the block of FIG. 1.

An embodiment of a block 10 of the present invention is shown in FIGS. 1-4. The block 10 comprises a front surface 12, side surfaces 14 and 16, a rear surface 18, a top surface 20 and a bottom surface 22. Although front surface 12, as depicted, features a straight face with beveled edges 24, it is understood that it other surface configurations and finishes may be used.

Generally, each side surface 14 and 16 comprises a plurality of sections that are angled with respect to each other. More specifically, side surface 14 comprises a first section 30, a second section 32, a third section 34 and a fourth section 36, and side surface 16 comprises a first section 31, a second section 33, a third section 35, and a fourth section 37. Since the sections of side surfaces 14 and 16 are mirror images of each other, only side surface 14 need be discussed in detail. As can be seen, the first section 30 extends from the front surface 12 towards the rear of the block and terminates at the intersection with the second section 32. The second section 32 extends towards the center of the block and terminates at the intersection with the third section 34. Continuing on, the third section 34 extends towards the rear of the block and terminates at the intersection with the fourth section 36, and the fourth section 36 extends toward the rear of the block and terminates at the intersection with the rear surface 18 thereof. Note that the first section of each side is configured so that when a plurality of blocks are arranged in a convex course so that first sections of adjacent blocks are in confronting relation, the size of the vertical joint formed thereby is minimized. Note that the second section of each side forms a generally laterally extending shoulder that is configured to abuttingly receive a projection of vertically adjacent block. Note that the second section of each side is positioned outwardly beyond the lateral extent of the rear surface. And note that the fourth section of each side is configured so that when a plurality of blocks are arranged in a convex course the fourth sections of adjacent blocks permit the first sections of adjacent blocks to be positioned adjacent to each other in a close fitting relation.

The bottom surface 22 comprises a front projection 40 and a rear projection 60. More specifically, the front projection 40 comprises a contact edge 42, side edges 44 and 46, a back edge 48 and a bottom 50. The contact edge 42 is configured and arranged so that when a block is positioned upon a lower course of blocks and slid forward, the contact edge 42 abuts against at least one shoulder of a block therebelow.

This positions the block relative to the course of blocks therebelow and prevents forward movement due to pressure exerted from backfill material. Note that the side edges 44 and 46 are configured so that they do not interfere with the third sections of blocks when a plurality of blocks is arranged in a convex course.

The rear projection 60 of the bottom surface 22 has a contact edge 62, side edges 64 and 66, a back edge 68 and a bottom 70. When a plurality of blocks are arranged in convex courses, the contact edge 62 may serve to further position the block relative to the course of blocks therebelow and prevent forward movement due to pressure exerted from backfill material be coming into an abutting relation with the rear surface of a block therebelow. As with the front projection, the contact edge 62 of the rear projection is configured and arranged so that when a block is positioned upon a convexly shaped lower course of blocks and slid forward, the contact edge 62 may abut against at least one rear surface of a block therebelow. Another function of the rear projection is to facilitate stacking onto a pallet for shipping.

The block 10 includes a through hole 80 that extends from the top surface 20 to the bottom surface 22. As will be appreciated, the through hole 80 serves several functions. It reduces the amount of material needed to form the block and it reduces overall weight of the block 10, which makes it easier to lift and manipulate.

Figure 5:
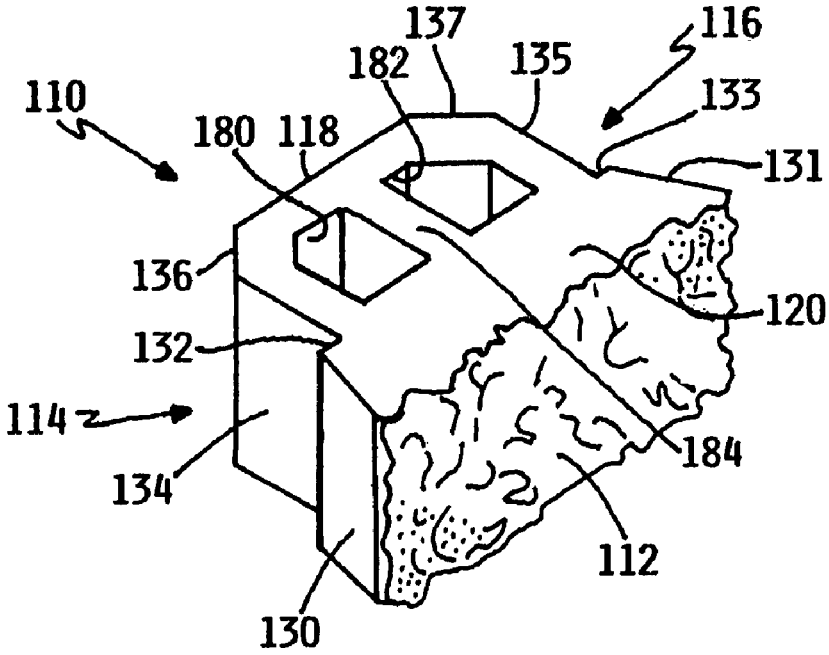
FIG. 5 is a perspective view of another embodiment of a block of the present invention, looking down to reveal the details of the top and front surfaces.
Figure 6:
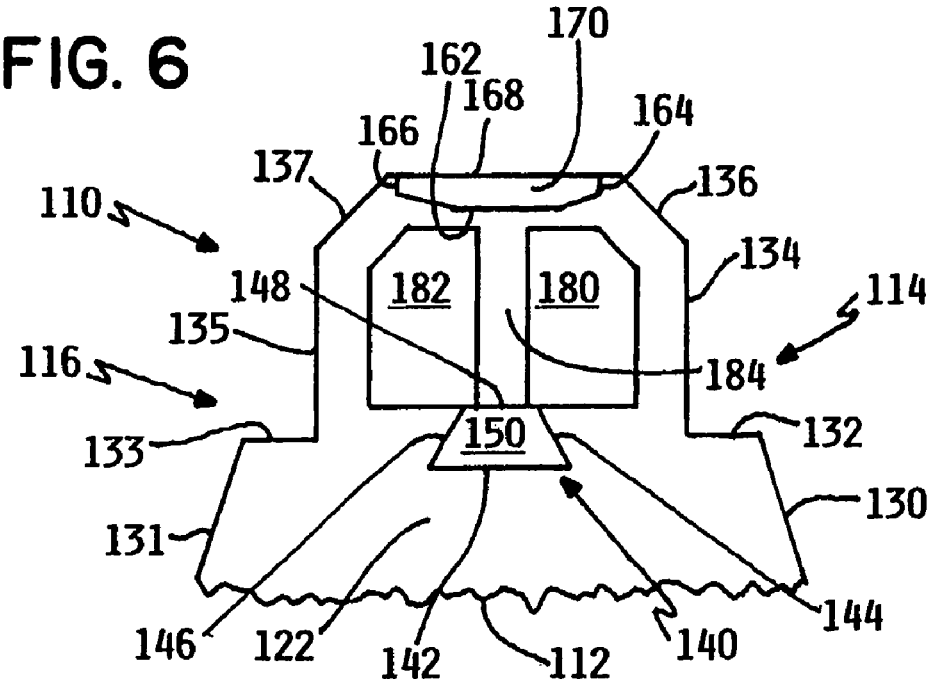
FIG. 6 is a bottom plan view of the block of FIG. 5.

Another embodiment of a block 110 of the present invention is shown in FIGS. 5-6. As with the previously described embodiment, this block 110 comprises a front surface 112, side surfaces 114 and 116, a rear surface 118, a top surface 120 and a bottom surface 122. Although front surface 112, as depicted, features a weathered or roughened face, it is understood that it other surface configurations and finishes may be used.

Each side surface 114 and 116 of block 110 comprises a plurality of sections that are angled with respect to each other. As depicted, side surface 114 comprises a first section 130, a second section 132, a third section 134 and a fourth section 136, while side surface 116 comprises a first section 131, a second section 133, a third section 135, and a fourth section 137. Since the sections of side surfaces 114 and 116 are mirror images of each other, only side surface 114 need be discussed in detail. More specifically, the first section 130 extends from the front surface 112 towards the rear of the block and terminates at the intersection with the second section 132, the second section 132 extends towards the center of the block and terminates at the intersection with the third section 134, the third section 134 extends towards the rear of the block and terminates at the intersection with the fourth section 136, and the fourth section 136 extends toward the rear of the block and terminates at the intersection with the rear surface 118 thereof.

As with the previously described embodiment, the first section of each side is configured so that when a plurality of blocks are arranged in a convex course so that first sections of adjacent blocks are in confronting relation, the size of the vertical joint formed thereby is minimized. Similarly, the second section of each side forms a shoulder that is configured to abuttingly receive a projection of vertically adjacent block. In addition, the fourth section of each side is configured so that when a plurality of blocks are arranged in a convex course the fourth sections of adjacent blocks permit the first sections of adjacent blocks to be positioned adjacent to each other in a close fitting relation.

The bottom surface 122 of block 110 comprises a front projection 140 and a rear projection 160. More specifically, the front projection 140 comprises a contact edge 142, side edges 144 and 146, a back edge 148 and a bottom 150. The contact edge 142 is configured and arranged so that when a block is positioned upon a lower course of blocks and slid forward, the contact edge 142 abuts against at least one shoulder of a block therebelow. This positions the block relative to the next lower course of blocks therebelow and prevents forward movement due to pressure exerted from backfill material. The side edges 144 and 146 are configured so that they do not interfere with the third sections of blocks when a plurality of blocks is arranged in a convex course.

The rear projection 160 of the bottom surface 122 has a contact edge 162, side edges 164 and 166, a back edge 168 and a bottom 170. When a plurality of blocks are arranged in convex courses, the contact edge 162 may serve to further position the block relative to the course of blocks therebelow and prevent forward movement due to pressure exerted from backfill material be coming into an abutting relation with the rear surface of a block therebelow. As with the front projection, the contact edge 162 of the rear projection 160 is configured and arranged so that when a block is positioned upon a convexly shaped lower course of blocks and slid forward, the contact edge 162 may abut against at least one rear surface of a block therebelow. Another function of the rear projection is to facilitate stacking onto a pallet for shipping.

The block 110 differs from the previously described embodiment in that instead of having a single through hole, this embodiment includes two through holes 180,182, that extend from the top surface 120 to the bottom surface 122. The through holes 180, 182 are separated from each other by a web 184, which serves to strengthen the block.

Figure 7:
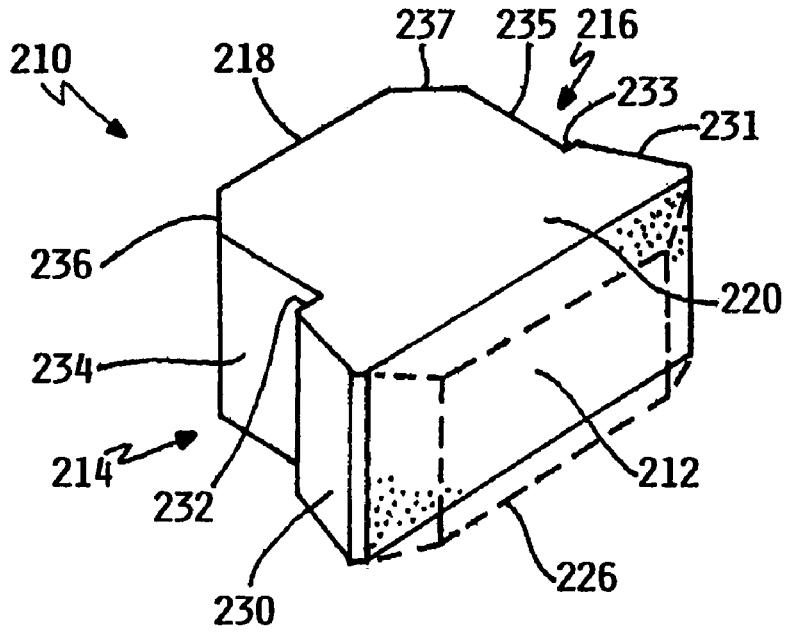
FIG. 7 is a perspective view of another embodiment of a block of the present invention, looking down to reveal the details of the top and front surfaces.
Figure 8:
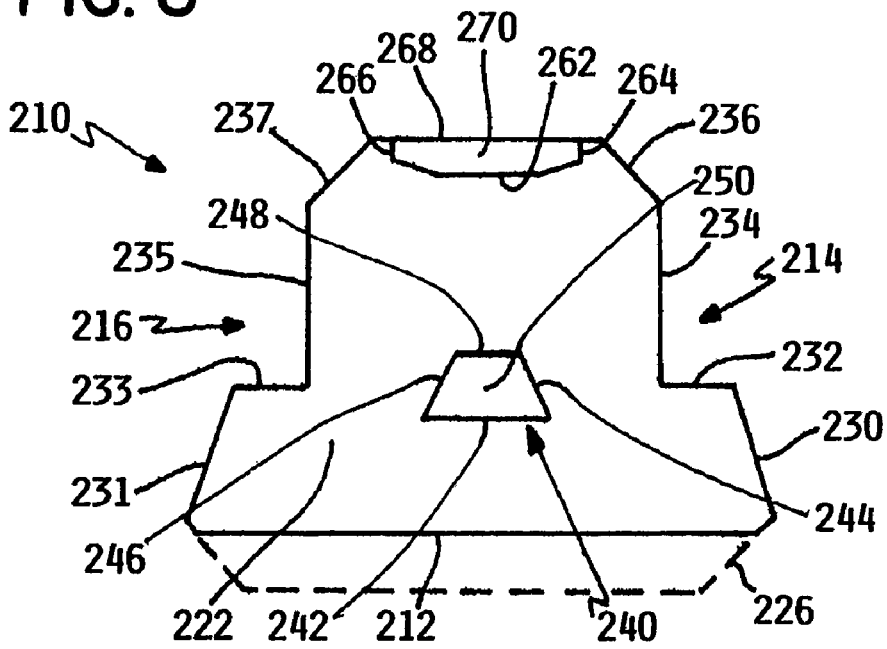
FIG. 8 is a bottom plan view of the block of FIG. 7.
Figure 9:
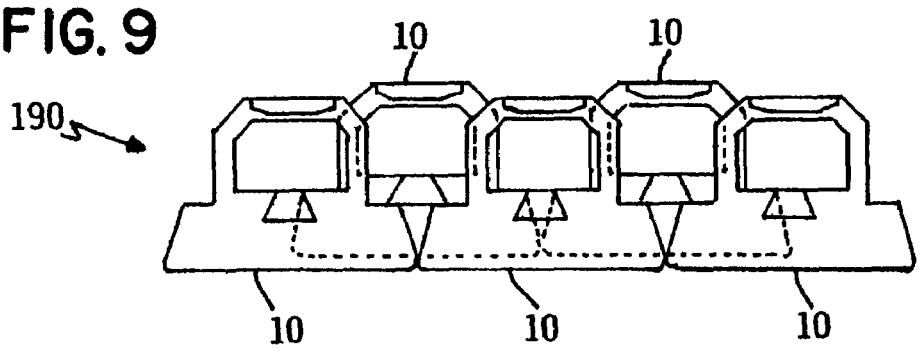
FIG. 9 is a bottom plan view of a segment of a linear wall formed by a plurality of blocks of FIG. 1, with the lower course of blocks shown in black and the upper course of blocks shown in phantom.

As will be appreciated, the through holes 180 and 182 serve several functions. They reduce the amount of material needed to form the block and they reduce overall weight of the block 110, which makes it easier to lift and manipulate Another embodiment of the present invention is shown in FIGS. 7-8. As with the previously described embodiments, this block 210 comprises a front surface 212, side surfaces 214 and 216, a rear surface 218, a top surface 220 and a bottom surface 222. Although front surface 212, as depicted, features a straight, it is understood that it other surface configurations and finishes may be used. For example, the front surface may be provided with a plurality of facets 226 (shown in dashed lines).

Each side surface 214 and 216 comprises a plurality of sections that are angled with respect to each other. As depicted, side surface 214 comprises a first section 230, a second section 232, a third section 234 and a fourth section 236, while side surface 216 comprises a first section 231, a second section 233, a third section 235, and a fourth section 237. Since the sections of side surfaces 214 and 216 are mirror images of each other, only side surface 214 need be discussed in detail. More specifically, the first section 230 extends from the front surface 212 towards the rear of the block and terminates at the intersection with the second section 232, the second section 232 extends towards the center of the block and terminates at the intersection with the third section 234, the third section 234 extends towards the rear of the block and terminates at the intersection with the fourth section 236, and the fourth section 236 extends toward the rear of the block and terminates at the intersection with the rear surface 218 thereof.

As with the previously described embodiments, the first section of each side is configured so that when a plurality of blocks are arranged in a convex course so that first sections of adjacent blocks are in confronting relation, the size of the vertical joint formed thereby is minimized. Similarly, the second section of each side forms a shoulder that is configured to abuttingly receive a projection of vertically adjacent block.

In addition, the fourth section of each side is configured so that when a plurality of blocks are arranged in a convex course the fourth sections of adjacent blocks permit the first sections of adjacent blocks to be positioned adjacent to each other in a close fitting relation.

The bottom surface 222 of block 210 comprises a front projection 240 and a rear projection 260. More specifically, the front projection 240 comprises a contact edge 242, side edges 244 and 246, a back edge 248 and a bottom 250. The contact edge 242 is configured and arranged so that when a block is positioned upon a lower course of blocks and slid forward, the contact edge 242 abuts against at least one shoulder of a block therebelow. This positions the block relative to the next lower course of blocks therebelow and prevents forward movement due to pressure exerted from backfill material. The-side edges 244 and 246 are configured so that they do not interfere with the third sections of blocks when a plurality of blocks is arranged in a convex course.

The rear projection 260 of the bottom surface 222 has a contact edge 262, side edges 264 and 266, a back edge 268 and a bottom 270. When a plurality of blocks are arranged in convex courses, the contact edge 262 may serve to further position the block relative to the course of blocks therebelow and prevent forward movement due to pressure exerted from backfill material be coming into an abutting relation with the rear surface of a block therebelow. As with the front projection, the contact edge 262 of the rear projection 260 is configured and arranged so that when a block is positioned upon a convexly shaped lower course of blocks and slid forward, the contact edge 262 may abut against at least one rear surface of a block therebelow. Another function of the rear projection is to facilitate stacking onto a pallet for shipping.

The block 210 differs from the previously described embodiments in that instead of having a single or multiple through holes, this embodiment has a substantially solid and continuous top surface 220. As will be appreciated, this embodiment is comparatively robust and may be used in applications where force exerted by backfill is expected to be relatively high.

Examples of the types of wall structures that may be constructed using above described blocks are depicted in FIGS. 9-12. The wall structure 190 of FIG. 9 comprises two courses of blocks are linearly arranged, with the bottommost course of blocks depicted in black, and with the second, uppermost course depicted in phantom.

Figure 10:
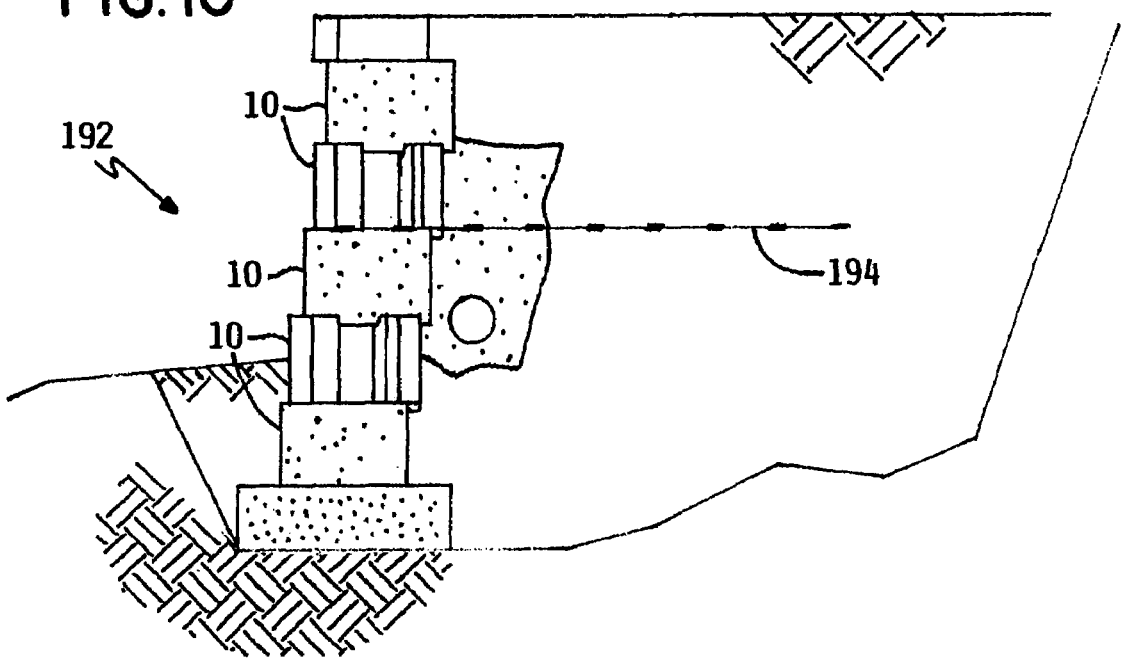
FIG. 10 is a side elevational view of a wall formed by a plurality of blocks of FIG. 1.
Figure 11:
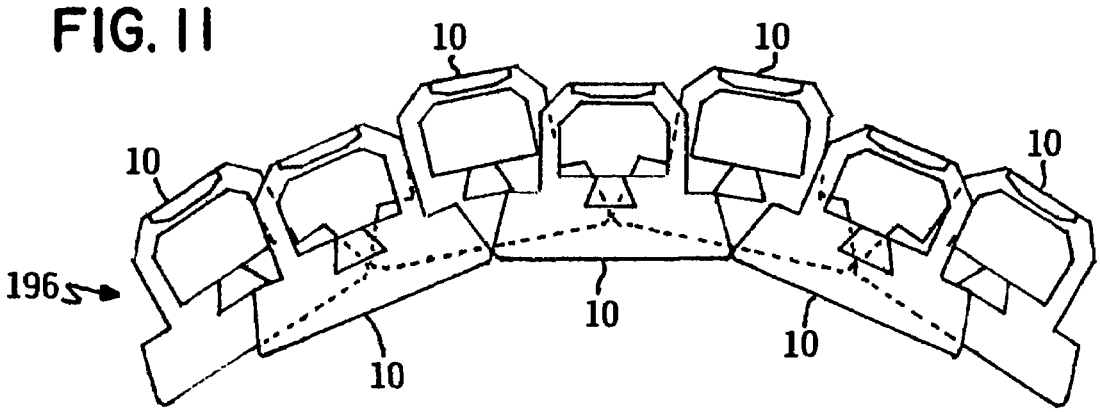
FIG. 11 is a bottom plan view of a segment of a concave wall formed by a plurality of blocks of FIG. 1, with the lower course of blocks shown in black and the upper course of blocks shown in phantom.
Figure 12:
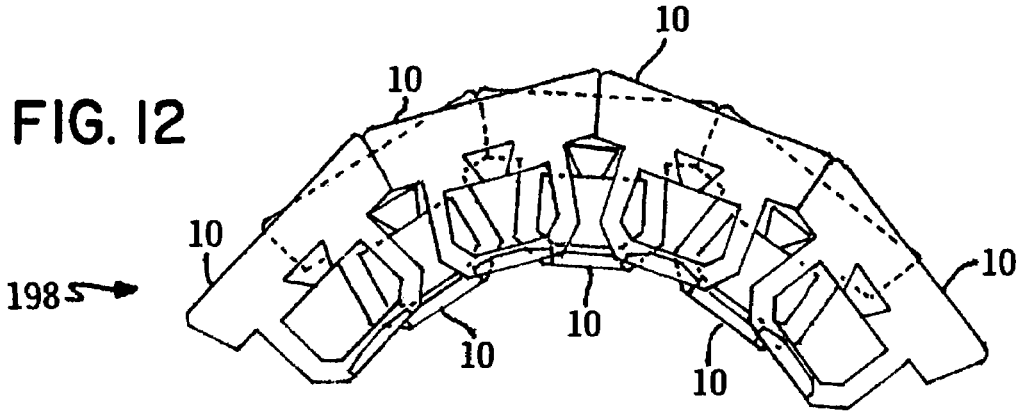
FIG. 12 is a bottom plan view of a segment of a convex wall formed by a plurality of blocks of FIG. 1, with the lower course of blocks shown in black and the upper course of blocks shown in phantom.
Figure 13:
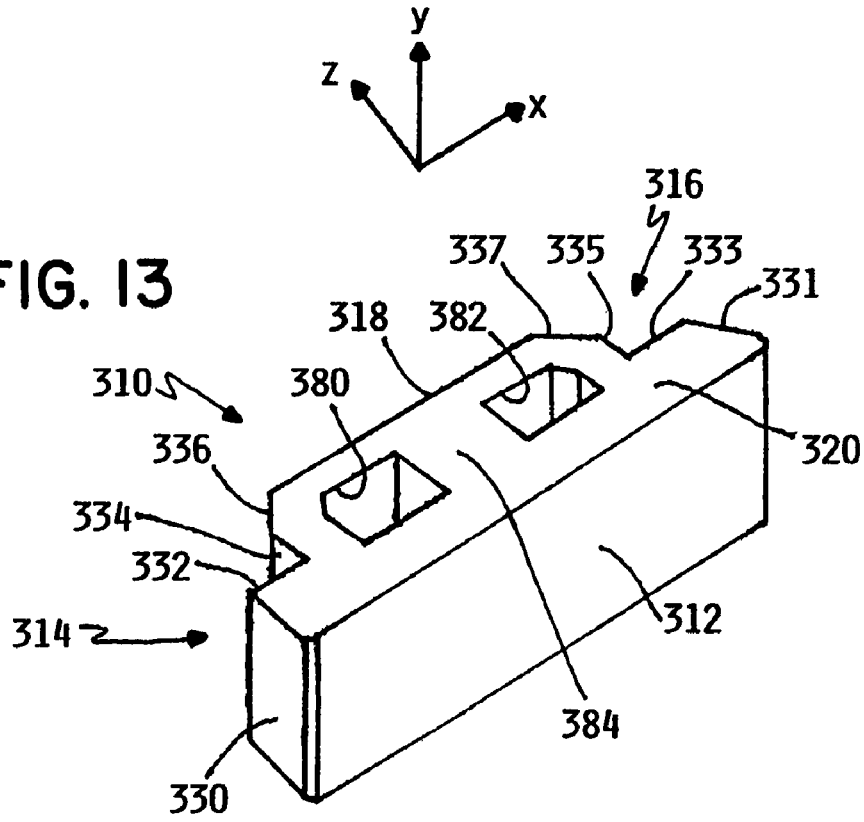
FIG. 13 is a perspective view of a another embodiment of a block of the present invention, looking down to reveal the details of the top and front surfaces.
Figure 14:
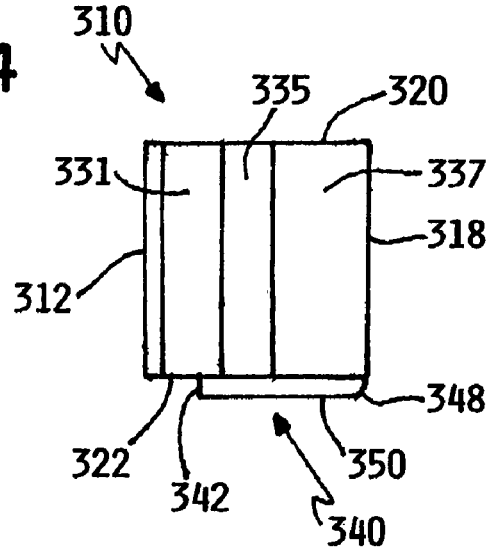
FIG. 14 is a side elevational view of the block of FIG. 13.
Figure 15:
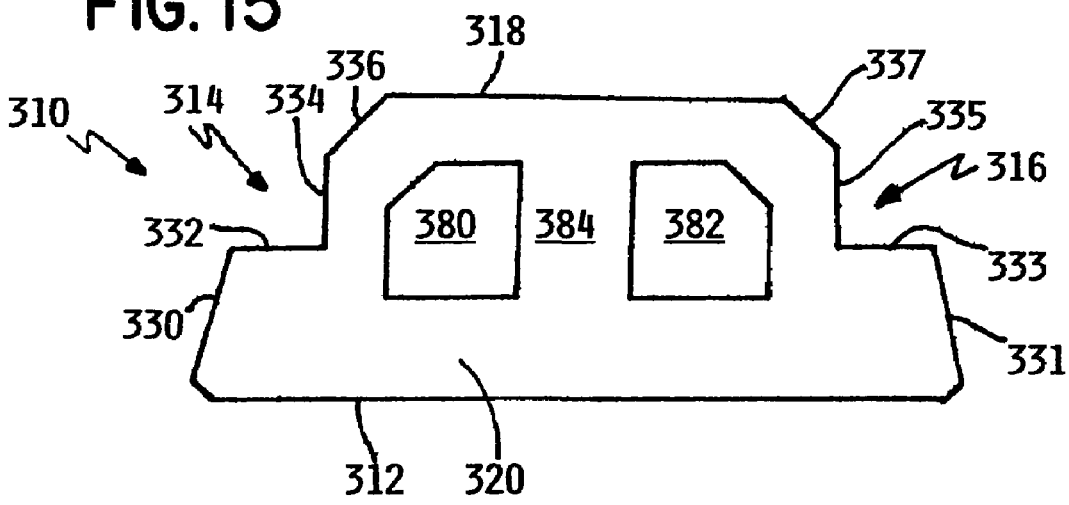
FIG. 15 is a top plan view of the block of FIG. 13.
Figure 16:
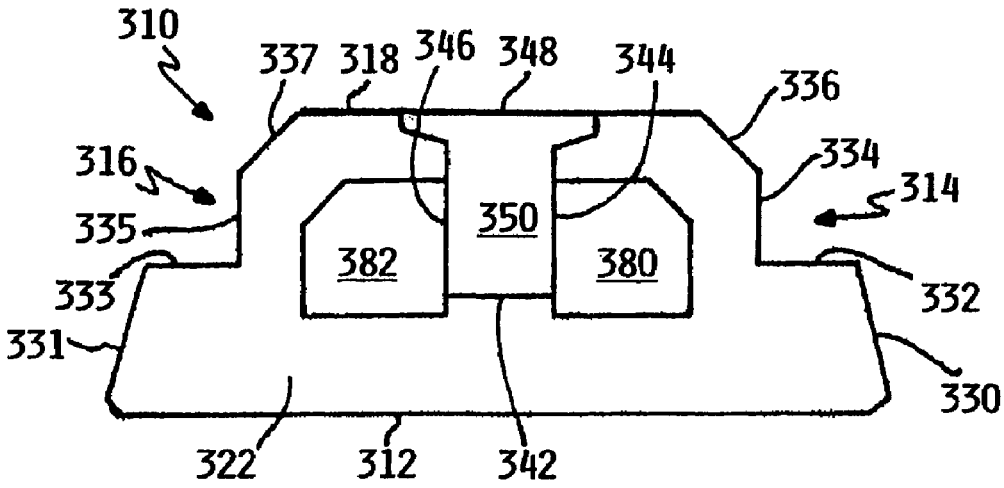
FIG. 16 is a bottom plan view of the block of FIG. 13.
Figure 17:
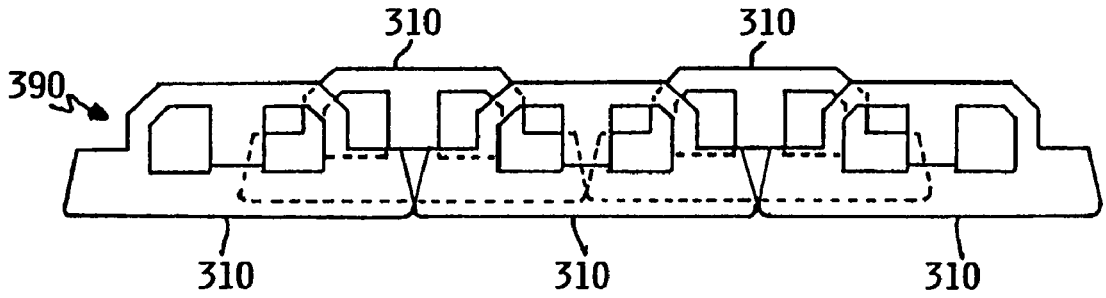
FIG. 17 is a bottom plan view of a segment of a linear wall formed by a plurality of blocks of FIG. 13, with the lower course of blocks shown in black and the upper course of blocks shown in phantom.

The wall structure 192 of FIG. 10, which comprises a plurality of courses in side elevation, also shows the use of an earth anchor or grid 194 therewith. It will be understood that the particular type of earth anchor used with the above described blocks is up to the discretion of a user. For example, a user may use a metallic lattice earth anchor, or a flexible plastic earth anchor. The wall structures 196, 198 of FIGS. 11 and 12, respectively depict arrangements that are generally concave and generally convex. It will be understood that foregoing wall structures may be constructed with any of the above described embodiments, or with combinations thereof.

Another embodiment of the present invention is shown in FIGS. 13-16. With this embodiment, the shape of the block 310 is wider and shallower compared to the previously described embodiments. This enables the block to be formed with existing molding machinery in a more efficient manner. And, because the block has a larger front surface than conventional blocks, it takes fewer blocks to form a wall structure. It will be appreciated that this has the effect of speeding up construction. Preferably, the block has a width in the range of about 18 to 38 inches (46 to 96 cm), a height in the range of about 4 to 12 inches (10 to 30 cm), and a depth in the range of about 4 to 24 inches (10 to 60 cm). More preferably, the block has a width in the range of about 20 to 24 inches (50 to 60 cm), a height in the range of about 4 to 9 inches (10 to 23 cm), and a depth in the range of about 9 to 12 inches 23 to 30). Expressed alternatively, the block may have a volume in the range of about 288 to 1,800 cubic inches (4,680 to 28,800 cc) or a weight in the range of about 18 to 150 pounds (8 to 68 kg). Preferably, though, the width and depth dimensions (taken along the x and z directions in a three-dimensional coordinate system) are designed to be wholly divisible into the dimensions of existing mold pallets. Thus, for example, it is envisioned that two blocks could be cast in a mold box resting upon a pallet having a width of around 24 inches (60 cm) and a depth of around 18 inches (46 cm).

As with the previously described embodiments, this block 310 comprises a front surface 312, side surfaces 314 and 316, a rear surface 318, a top surface 320 and a bottom surface 322. Although front surface 312, as depicted, features a straight, it is understood that it other surface configurations and finishes may be used.

Each side surface 314 and 316 comprises a plurality of sections that are angled with respect to each other. As depicted, side surface 314 comprises a first section 330, a second section 332, a third section 334 and a fourth section 336, while side surface 316 comprises a first section 331, a second section 333, a third section 335, and a fourth section 337. Since the sections of side surfaces 314 and 316 are mirror images of each other, only side surface 314 need be discussed in detail. More specifically, the first section 330 extends from the front surface 312 towards the rear of the block and terminates at the intersection with the second section 332, the second section 332 extends towards the center of the block and terminates at the intersection with the third section 334, the third section 334 extends towards the rear of the block and terminates at the intersection with the fourth section 336, and the fourth section 336 extends toward the rear of the block and terminates at the intersection with the rear surface 318 thereof.

As with the previously described embodiments, the first section of each side is configured so that when a plurality of blocks are arranged in a convex course so that first sections of adjacent blocks are in confronting relation, the size of the vertical joint formed thereby is minimized. Similarly, each second section forms a shoulder that is configured to abuttingly receive a projection of vertically adjacent block. Note that each second section extends outwardly beyond the lateral extent of the rear surface of the block. In addition, each fourth section is configured so that when a plurality of blocks are arranged in a convex course the fourth sections of adjacent blocks permit the first sections of adjacent blocks to be positioned adjacent to each other in a close fitting relation.

The bottom surface 322 comprises a downwardly depending projection 340 comprising a contact edge 342, side edges 344 and 346, a back edge 348 and a bottom 350. The contact edge 342 is configured and arranged so that when a block is positioned upon a lower course of blocks and slid forward, the contact edge 342 abuts against at least one shoulder of a block therebelow. This positions the block relative to the next lower course of blocks therebelow and prevents forward movement due to pressure exerted from backfill material. The side edges 344 and 346 are configured so that they do not interfere with the third sections of blocks when a plurality of blocks is arranged in a convex course.

The block 310 is similar to one of the above described embodiments in that it includes two through holes 380 and 382, which extend from the top surface 320 to the bottom surface 322. The through holes 380, 382 are separated from each other by a web 384, which serves to strengthen the block. As will be appreciated, the through holes 380 and 382 serve several functions. They reduce the amount of material needed to form the block and they reduce overall weight of the block 310, which increases the facing area-to-block weight ratio, and which makes it easier to lift and manipulate. Because the weight of the block is comparable to the weight of prior art blocks, it will be appreciated that it takes fewer blocks and less time to construct a wall with the present invention that it would take build to build a similarly sized wall using prior art blocks.

Examples of the types of wall structures that may be constructed using above described blocks are depicted in FIGS. 17-20. The wall structure 390 of FIG. 17 comprises two courses of blocks are linearly arranged, with the bottommost course of blocks depicted in black, and with the second, uppermost course depicted in phantom. The wall structure 392 of FIG. 18, which comprises a plurality of courses in side elevation, also shows the use of an earth anchor or grid 394 therewith. It will be understood that the particular type of earth anchor used with the above described blocks is up to the discretion of a user. For example, a user may use a metallic lattice earth anchor, or a flexible plastic earth anchor. The wall structures 396 and 398 of FIGS. 19 and 20, respectively, depict arrangements that are generally concave and generally convex. It will be understood that foregoing wall structures may be constructed with any of the above described embodiments, or with combinations thereof.

In another embodiment, a block of the present invention is shown in FIGS. 21-26. This block is similar to the block of FIGS. 13-16 and has a preferred width in the range of about 18 to 38 inches (46 to 96 cm), a height in the range of about 4 to 12 inches (10 to 30 cm), and a depth in the range of about 4 to 24 inches (10 to 60 cm). More preferably, the block has a width in the range of about 20 to 24 inches (50 to 60 cm), a height in the range of about 4 to 9 inches (10 to 23 cm), and a depth in the range of about 9 to 12 inches 23 to 30). Expressed alternatively, the block may have a volume in the range of about 288 to 1,800 cubic inches (4,680 to 28,800 cc) or a weight in the range of about 18 to 150 pounds (8 to 68 kg). Preferably, though, the width and depth dimensions (taken along the x and z directions in a three-dimensional coordinate system) are designed to be wholly divisible into the dimensions of existing mold pallets. Thus, for example, it is envisioned that two blocks could be cast in a mold box resting upon a pallet having a width of around 24 inches (60 cm) and a depth of around 18 inches (46 cm).

As with the previously described embodiments, block 410 comprises a front surface 412, side surfaces 414 and 416, a rear surface 418, a top surface 420 and a bottom surface 422. Although front surface 412, as depicted, is substantially planar, it is understood that it other surface configurations and finishes may be used.

Each side surface 414 and 416 comprises a plurality of sections that are angled with respect to each other. As depicted, side surface 414 comprises a first section 430, a second section 432, a third section 434 and a fourth section 436, while side surface 416 comprises a first section 431, a second section 433, a third section 435, and a fourth section 437. Since the sections of side surfaces 414 and 416 are mirror images of each other, only side surface 414 need be discussed in detail. More specifically, the first section 430 extends from the front surface 412 towards the rear of the block and terminates at the intersection with the second section 432, the second section 432 extends towards the center of the block and terminates at the intersection with the third section 434, the third section 434 extends towards the rear of the block and terminates at the intersection with the fourth section 436, and the fourth section 436 extends toward the rear of the block and terminates at the intersection with the rear surface 418 thereof.

The first and fourth sections of each side are configured so that when a plurality of blocks are arranged in a convex course so that first sections of adjacent blocks are in confronting relation, the size of the vertical joint formed thereby is minimized. As will be appreciated, the second and third sections of each side are configured to reduce the amount of material needed to manufacture the block. This has the additional benefit of reducing the overall weight of the block and makes it easier to lift and manipulate. As will be noted in FIGS. 24 and 25, section 430 and 432 intersect each other at a first predetermined angle that may be greater than 90 degrees as shown at 450, or less than 90 degrees as shown at 452 where section 433 intersects with section 431' (shown in dashed lines). Thus, the intersection between the first and second sections can have a range of about 45-145 degrees. Preferably, though, the preferred angle is about 105 degrees. Continuing on, the second and third sections 432 and 434 intersect each other at a second predetermined angle that may be less than 90 degrees (not shown), or greater than 90 degrees as shown at 456 where section 432' intersects with section 434' (shown in dashed lines). Thus, the intersection between the second and third sections can have a range of about 80 to 135 degrees. Preferably, though, the preferred angle is about 90 degrees.

The top surface 420 comprises an upwardly extending projection 440 comprising a forward facing portion 442, a contact portion 444, a top 446 and side portions 447 and 449. The contact portion 444 is configured and arranged so that when a block in a successive upper course is positioned thereon and slid forward, a forward facing surface of the upper course block engages the contact portion 444. This positions the upper course block relative to the next lower course of blocks therebelow and prevents forward movement due to pressure exerted from backfill material (see, FIG. 27). Side portions 447 and 449 are generally coplanar with the side surface segments 430 and 431. Although the forward facing portion 442 is depicted as being generally coplanar with the front surface 412, it is understood that this need not be necessarily so. For example, the forward facing portion 442 may be angled rearwardly with respect to the front surface, or it may be provided with other decorative treatments such as quarter rounding (not shown). The top surface 420 may include notches 421 and 423, which are configured to receive portions of clips 500 that are used to operatively connect the block to an earth anchor. Note that the notches are of sufficient depth so that the top surfaces of the clips are substantially level with the top surface of the block. However, it will be understood that the notches may be deeper than the thickness of the clips so that the point of attachment between a block and an earth anchor may be more centrally located (see, notch 421 in FIG. 21, and clip 500 shown in dashed lines in FIG. 22). Likewise, the bottom surface 422 may include similar notches 425 and 427, which are configured to receive portions of clips 500.

Figure 23:
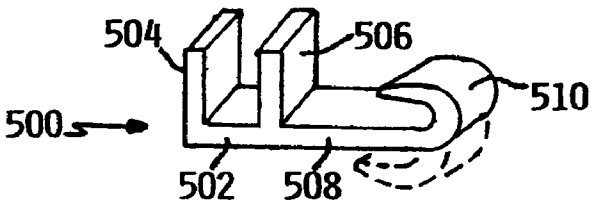
FIG. 23 is a perspective view of the clip shown in FIGS. 21 and 22.

An embodiment of a clip 550 is depicted in FIG. 23. As can be seen, the clip 500 comprises a body 502 having a block engaging segment formed by one or more laterally extending legs 504 and 506 that are configured to engage a block. For example, the point of engagement may be one or more vertical apertures, or a web (as shown). The earth anchor engaging segment 508 is generally in alignment with the body 502 and terminates in a fastening element that is operatively connected to an earth anchor. While the fastening element may take various forms, which may include separate fasteners such as nuts and bolts, adhesives, or rivets, a hook 510 is preferred.

Figure 21:
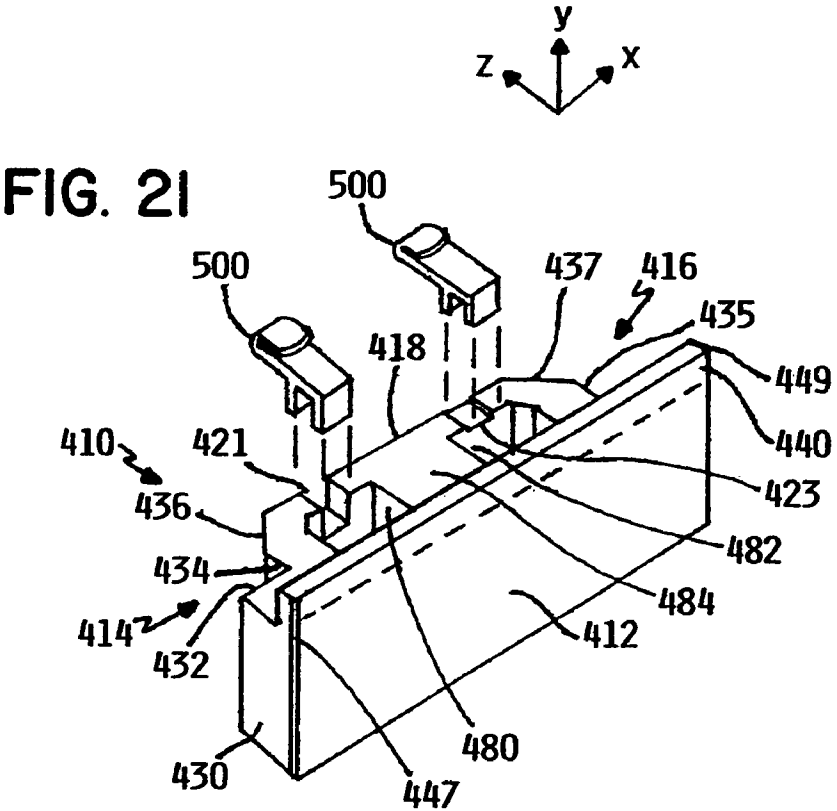
FIG. 21 is an alternative embodiment showing a block that is provided with an upwardly extending projection and a pair of clips that may be used to connect the block to an earth anchor.
Figure 22:
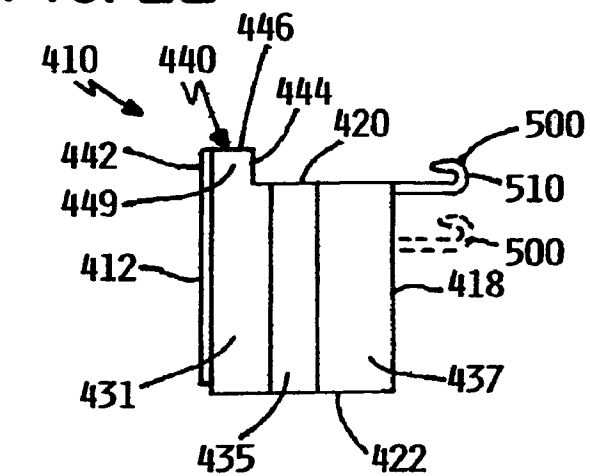
FIG. 22 a side elevational view of the block of FIG. 21.

The hook may be oriented in the same direction as the laterally extending legs as shown in FIG. 23, or in the opposite direction as shown in FIGS. 21 and 22.

Block 410 is similar to block 310 in that it may include two through holes 480 and 482, which extend from the top surface 420 to the bottom surface 422. The through holes 480, 482 are separated from each other by a web 484, which serves to strengthen the block. As will be appreciated, the through holes 480 and 482 serve several functions. They reduce the amount of material needed to form the block and they reduce overall weight of the block 410, which makes it easier to lift and manipulate.

Figure 18:
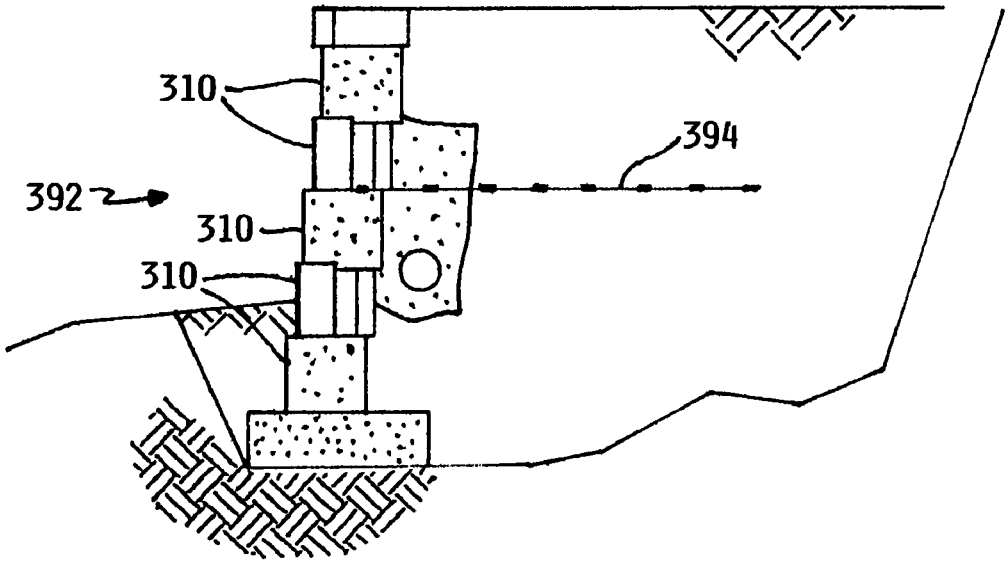
FIG. 18 is a side elevational view of a wall formed by a plurality of blocks of FIG. 13.
Figure 19:
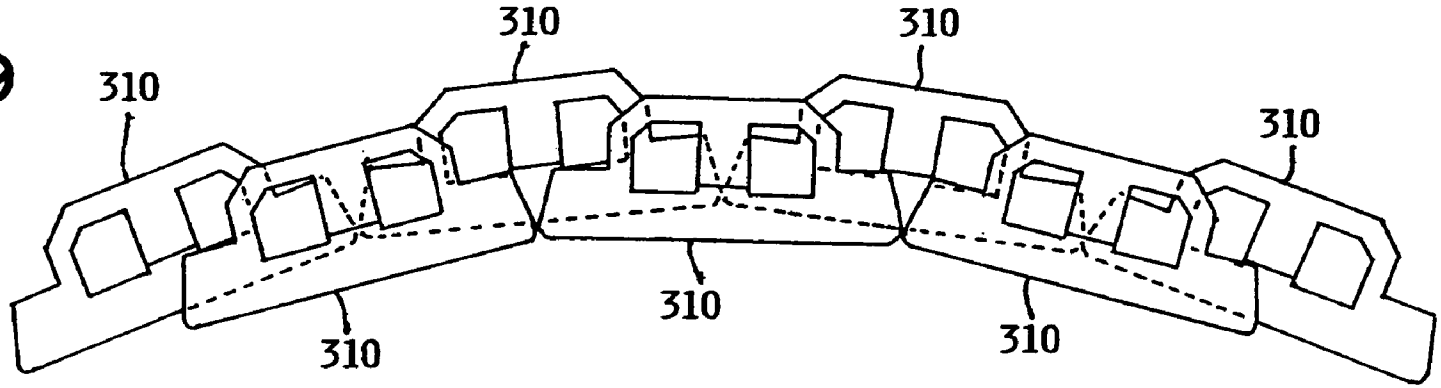
FIG. 19 is a bottom plan view of a segment of a concave wall formed by a plurality of blocks of FIG. 13 with the lower course of blocks shown in black and the upper course of blocks shown in phantom.
Figure 20:
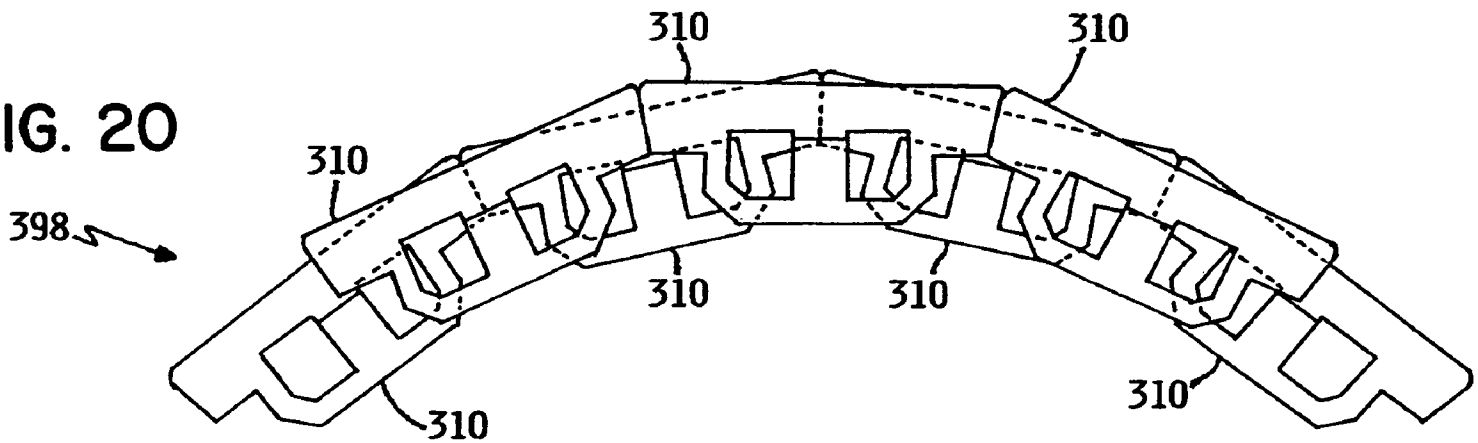
FIG. 20 is a bottom plan view of a segment of a convex wall formed by a plurality of blocks of FIG. 13, with the lower course of blocks shown in black and the upper course of blocks shown in phantom.
Figure 27:
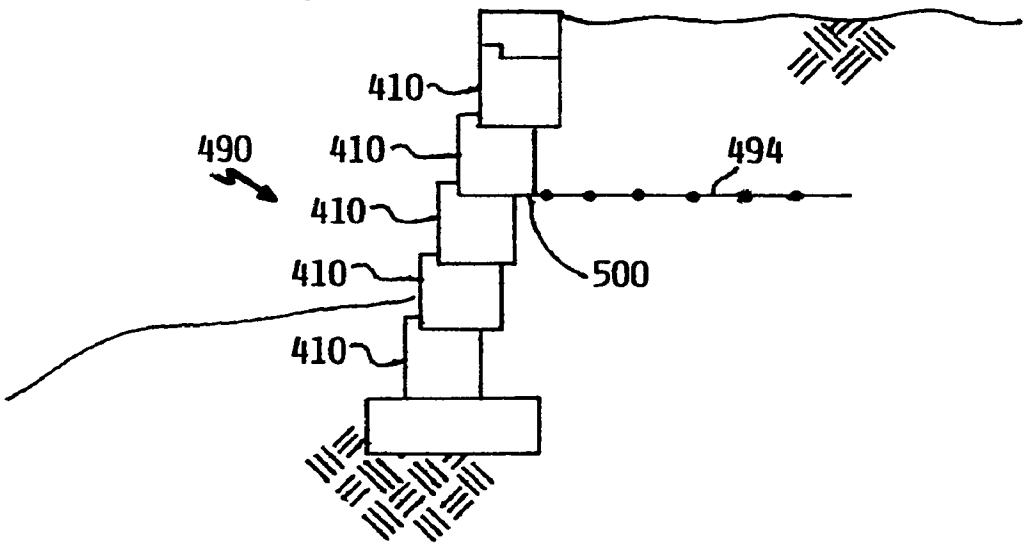
FIG. 27 is a side elevational view of a wall formed by a plurality of blocks of FIG. 21, at least one clip, and an earth anchor.
Figure 26:
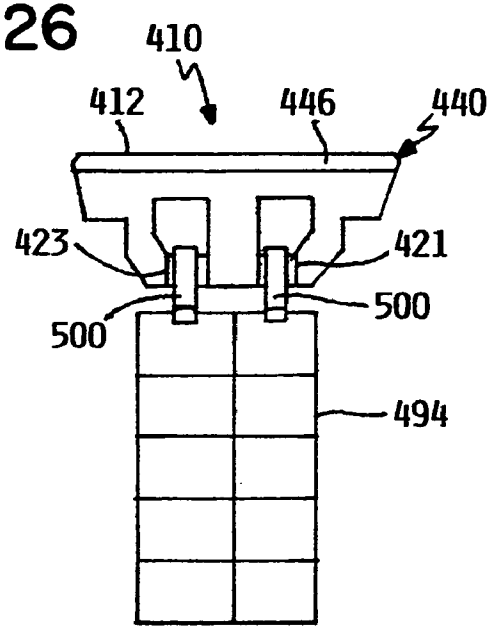
FIG. 26 is a top plan view of the block of FIG. 21 in combination with clips and an earth anchor.
Figure 29:
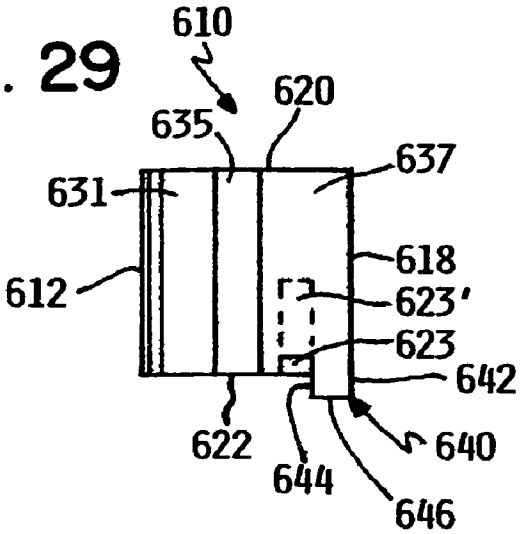
FIG. 29 is a side elevational view of the block of FIG. 28.
Figure 28:
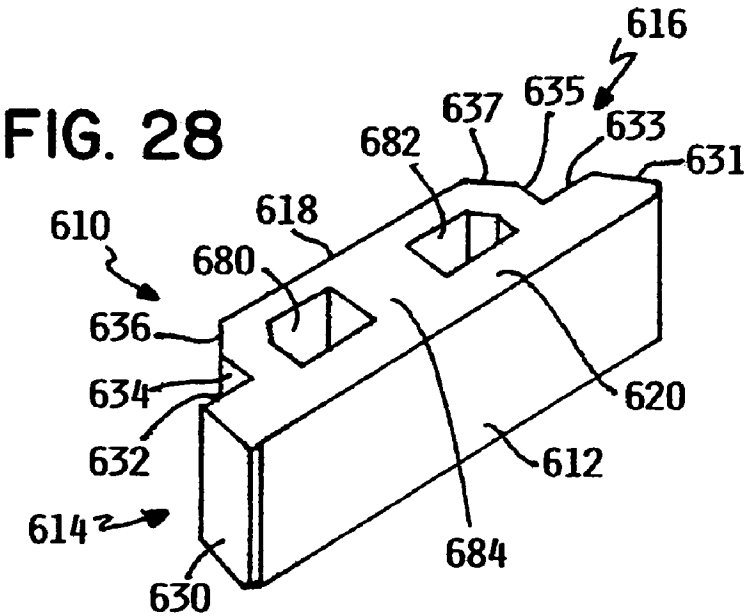
FIG. 28 is an alternative embodiment showing a block that is provided with a downwardly depending projection located towards the back of the block.
Figure 30:
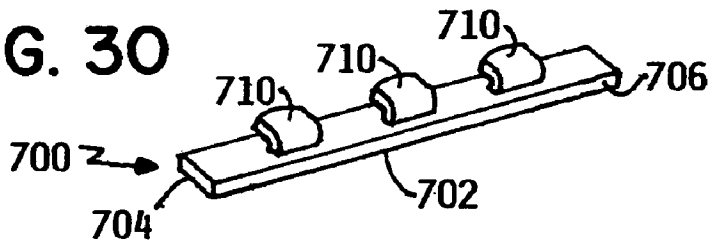
FIG. 30 is a perspective view of a attachment bar that may be used with a plurality of blocks shown in FIG. 21.
Figure 31:
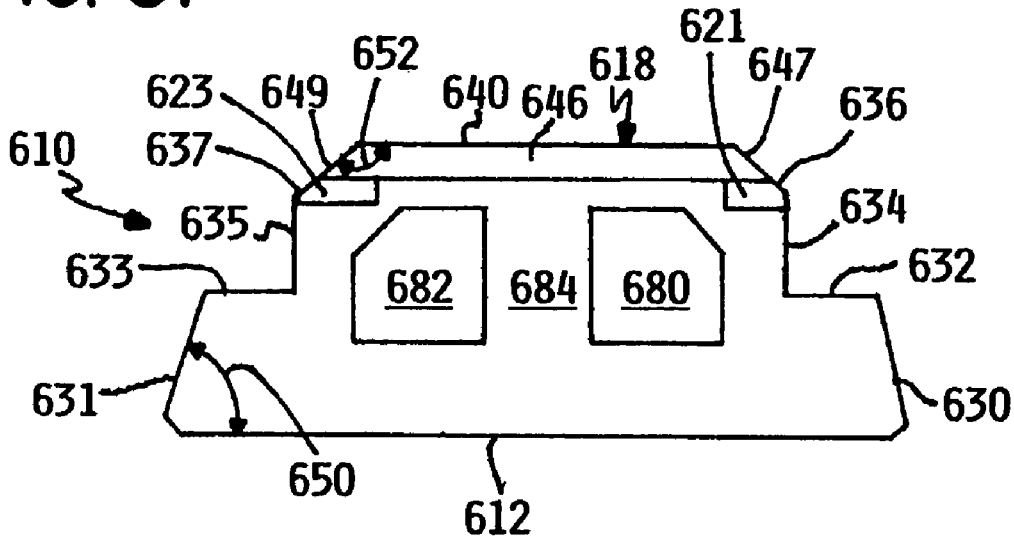
FIG. 31 is a bottom plan view of the block of FIG. 28.
Figure 32:
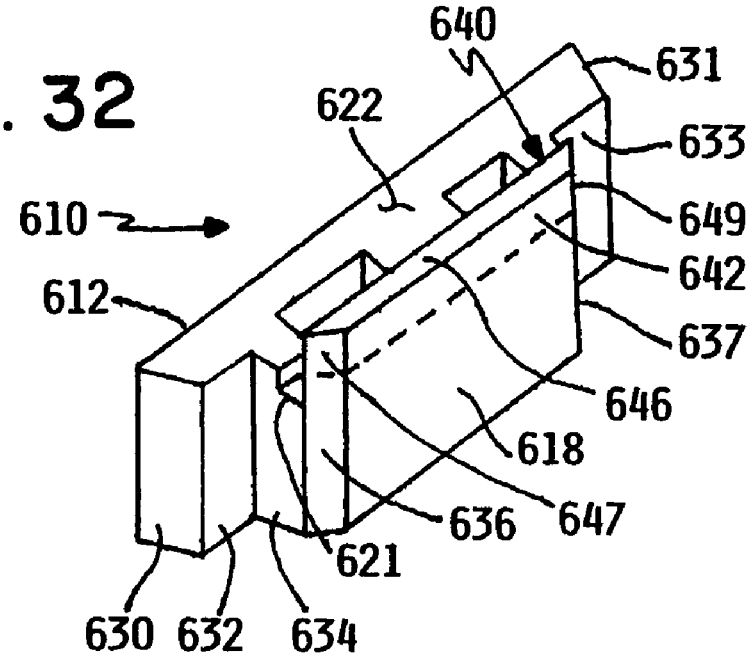
FIG. 32 is a perspective view of the block of FIG. 28.
Figure 34:
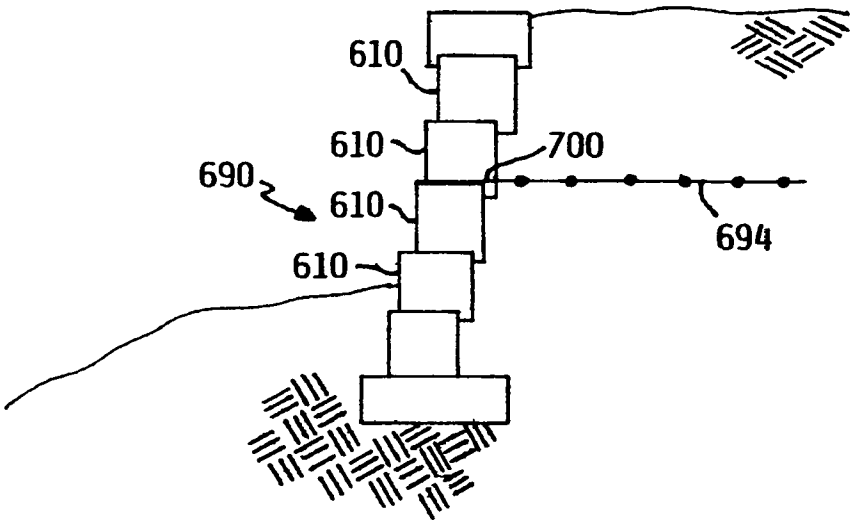
Figure 33:
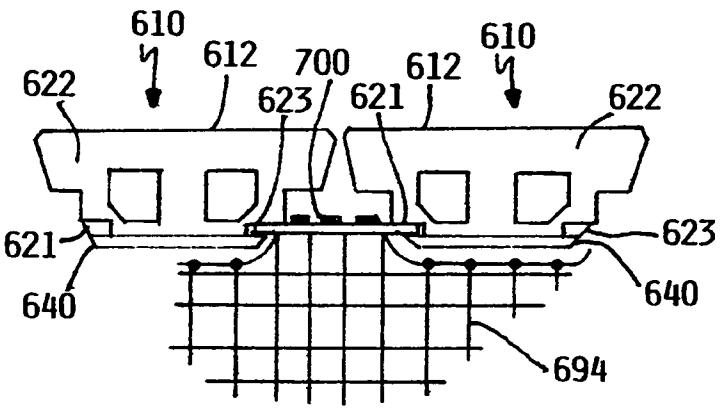
FIG. 33 is a bottom plan view of two adjacent blocks in combination with an attachment bar and an earth anchor; and, FIG. 34 is a side elevational view of a wall formed by a plurality of blocks of FIG. 28, at least one attachment bar, and an earth anchor.

A wall structure that may be constructed using above described blocks is depicted in FIGS. 26 and 27. Here, the wall structure 490, comprising a plurality of blocks 410 in a plurality of courses, is depicted in side elevation. As with FIGS. 10 and 18, FIG. 27 shows the use of an earth anchor or grid 494. Note that the earth anchor 494 is operatively connected to the wall structure 490 by clip 500 (see, for example, FIG. 26). It will be understood that the particular type of earth anchor used with the above described blocks is up to the discretion of a user. For example, a user may use a metallic lattice earth anchor, or a flexible plastic earth anchor.

In yet another alternative embodiment, a block of the present invention is shown in FIGS. 21-26. This block 610 is similar to the block of FIGS. 13-16 and has a preferred width in the range of about 18 to 38 inches, a preferred height in the range of about 4 to 12 inches, and a preferred depth in the range of about 4 to 24 inches. More preferably, the block has a width in the range of about 20 to 24 inches, a height in the range of about 4 to 9 inches, and a depth in the range of about 9 to 12 inches. Expressed alternatively, the block may have a volume in the range of about 288 to 1,800 cubic inches (4,680 to 28,800 cc) or a weight in the range of about 18 to 150 pounds (8 to 68 kg). The width and depth dimensions (taken along the x and z directions in a three-dimensional coordinate system) are designed to be wholly divisible into the dimensions of existing mold pallets. Thus, for example, it is envisioned that two blocks could be cast in a mold box resting upon a pallet having a width of around 24 inches and a depth of around 18 inches.

As with the previously described embodiments, block 610 comprises a front surface 612, side surfaces 614 and 616, a rear surface 618, a top surface 620 and a bottom surface 622. And although front surface 612, as depicted, is substantially planar, it is understood that it other surface configurations and finishes may be used.

Each side surface 614 and 616 comprises a plurality of sections that are angled with respect to each other. As depicted, side surface 614 comprises a first section 630, a second section 632, a third section 634 and a fourth section 636, while side surface 616 comprises a first section 631, a second section 633, a third section 635, and a fourth section 637. Since the sections of side surfaces 614 and 616 are mirror images of each other, only side surface 614 need be discussed in detail. More specifically, the first section 630 extends from the front surface 612 towards the rear of the block and terminates at the intersection with the second section 632, the second section 632 extends towards the center of the block and terminates at the intersection with the third section 634, the third section 634 extends towards the rear of the block and terminates at the intersection with the fourth section 636, and the fourth section 636 extends toward the rear of the block and terminates at the intersection with the rear surface 618 thereof.

Figure 24:
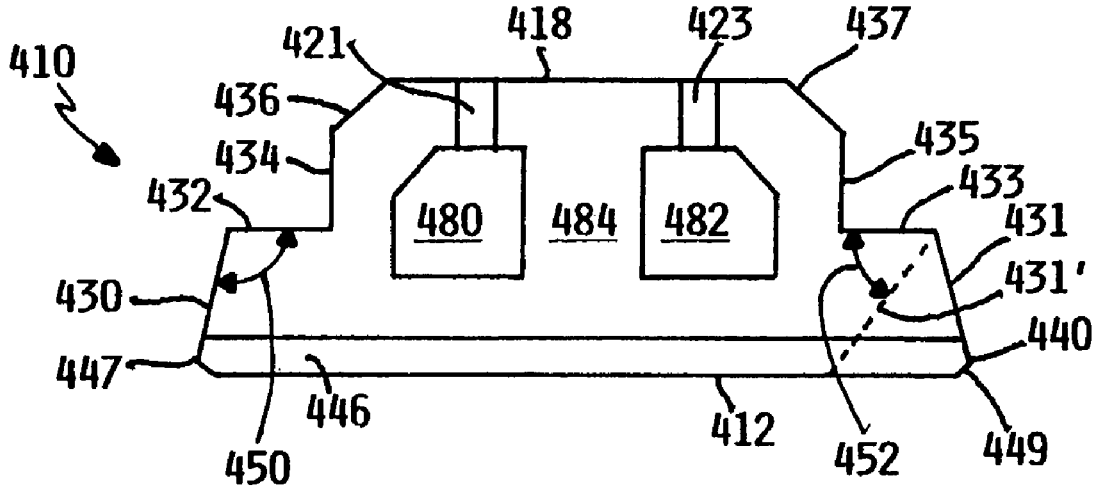
FIG. 24 is a top plan view of the block of FIG. 21.

As with the previously described embodiments, the first sections 630 and 631, and fourth sections 636 and 637 of each side are configured so that when a plurality of blocks are arranged in a convex course so that first sections of adjacent blocks are in confronting relation, the size of the vertical joint formed thereby is minimized. Thus, as can be seen in FIG. 24, the angle 650 formed by the front surface 612 and the first section is less than 90 degrees, while the angle 652 formed by the rear surface 618 and the fourth section 636 is greater than 90 degrees. As will be appreciated, the second and third sections 632 and 633, and 634 and 635, respectively, are configured to reduce the amount of material needed to manufacture the block. This has the additional benefit of reducing the overall weight of the block and makes it easier to lift and manipulate. As will be understood, the multi-sectional side surfaces need not intersect each other at a clearly definable edge. They could be provided with curved transitions if desired, without departing from the spirit and scope of the invention.

Figure 25:
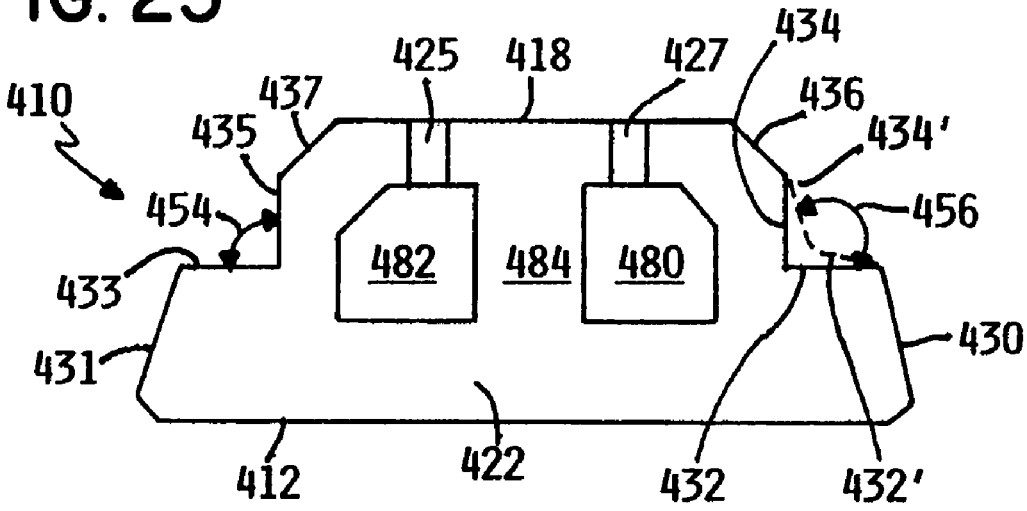
FIG. 25 is a bottom plan view of the block of FIG. 21.

The bottom surface 622 of block 610 is depicted in FIGS. 22, 24, and 25. As can be seen, the bottom surface 622 comprises an downwardly depending projection 640 comprising a contact portion 644, a rearward facing portion 642, a bottom 646 and side portions 647 and 649. The contact portion 644 is configured and arranged so that when the block is placed on the top surface of a lower course of blocks and slid forward, a contact portion 644 of the downwardly depending projection 640 engages a rearwardly forward surface of the course therebelow (see, for example, FIG. 27). This positions the block relative to the lower course therebelow and prevents forward movement due to pressure exerted from backfill material. Side portions 647 and 649 are generally coplanar with the side surface segments 630 and 631. Although the rearward facing portion 642 is depicted as being generally coplanar with the rear surface 618, it is understood that this need not be necessarily so. For example, the rearward facing portion 642 may be angled forwardly with respect to the rear surface 618, or it may be rounded over (not shown). The bottom surface 622 and side surfaces may include notches 621 and 623, which are configured to receive portions of attachment bars 700 that are used to operatively connect the block to an earth anchor. Note that the notches are of sufficient depth so that the bottom surfaces of the attachment bars are substantially level with the bottom surface of the block. However, it will be understood that the notches may extend vertically into the block for a distance greater than the thickness of the attachment bars so that the point of attachment between a block and an earth anchor may be more centrally located (see, notch 623' in FIG. 22 depicted in dashed lines). Likewise, the top surface 620 may include similar notches (not shown), which are configured to receive portions of attachment bars 700.

An embodiment of an attachment bar is depicted in FIG. 23. As can be seen, the attachment bar 700 comprises a body 702 having block engaging segments 704 and 706 that are configured to engage portions of adjacent blocks, and one or more fastening elements 710. Use of the attachment bar is fairly straightforward. For example, in a course of blocks, one block engaging segment 704 of bar 700 would be positioned in notch 621 of a first block while the other block engaging segment 706 of bar 700 would be positioned in notch 623 of a second adjacent block. Thus positioned, the bar would operatively connect two horizontally adjacent blocks together. An earth anchor can then be attached to the bar using one or more of the fastening elements (see, for example, FIG. 26). While the fastening element may take various forms, which may include separate fasteners such as nuts and bolts, adhesives, or rivets, one or more hooks 710 are preferred.

Block 610 is similar to block 310 in that it may include two through holes 680 and 682, which extend from the top surface 620 to the bottom surface 622. The through holes 680, 682 are separated from each other by a web 684, which serves to strengthen the block. As will be appreciated, the through holes 680 and 682 serve several functions. They reduce the amount of material needed to form the block and they reduce overall weight of the block 610, which makes it easier to lift and manipulate.

A wall structure that may be constructed using above described blocks is depicted in FIG. 27. Here, the wall structure 690, comprising a plurality of blocks 610 in a plurality of courses, is depicted in side elevation. As with FIGS. 10 and 18, FIG. 27 shows the use of an earth anchor or grid 694. Note that the earth anchor 694 is operatively connected to the wall structure 690 by attachment bar 700. It will be understood that the particular type of earth anchor used with the above described blocks is up to the discretion of a user. For example, a user may use a metallic lattice earth anchor, or a flexible plastic earth anchor.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

The invention claimed is:

1. A retaining wall block comprising:

a front portion having a front side presenting a block front surface, a back side, a top surface, a bottom surface, and a pair of rearwardly converging sides extending between the front side and the back side and a tail portion extending from the back side of the front portion intermediate the rearwardly converging sides, the tail portion having a rear side presenting a block rear surface, a top surface, a bottom surface, and a pair of opposing side surfaces, wherein the opposing side surfaces do not diverge as they extend rearwardly from the back side of the front portion and are substantially solid and uninterrupted by holes, recesses, or grooves the back side of the front portion presenting a pair of rearwardly facing shoulders that are substantially parallel with the front surface, each shoulder extending between a scoarate one of the opposing sides of the tail portion and a separate one of the rearwardly converging sides of the front portion, the top surface of the front portion and the top surface of the rear portion together defining a block top surface, the bottom surface of the front portion and the bottom surface of the rear portion together defining a block bottom surface, the block bottom surface comprising at least one projection configured and arranged such that when the front portion is engaged with a front portion of a laterally adjacent block in a multiple course wall structure, the projection abuttingly engages a rearwardly facing shoulder of a vertically adjacent block.

2. The retaining wall block of claim 1, further comprising a core hole extending from the block top surface to the block bottom surface.

3. The retaining wall block of claim 1 in combination with an earth anchor.

4. The retaining wall block of claim 1, wherein the block front surface has a width in the range of about 18 to 36 inches.

5. The retaining wail block of claim 1, wherein the block has a weight in the range of about 18 to 150 pounds.

6. The regaining wall block of claim 1, wherein the block front surface has a width in the range of about 18 to 36 inches and wherein the block front surface and the block rear surface define a block depth dimension therebetween, and wherein the block depth dimension is in the range of about 4 to 12 inches.

7. The retaining wall block of claim 1, wherein the lateral extent of the block rear surface is approximately two-thirds or less than the lateral extent of the block front surface.

8. A retaining wall block comprising:

a front surface;

a rear surface spaced from the front surface to define the depth of the block;

side surfaces;

a generally planar top surface; and a generally planar bottom surface;

with each side surface extending between the top surface and the bottom surface and comprising: a substantially planar first section extending generally rearwardly from the front surface; a substantially planar second section forming a generally laterally oriented, rear facing shoulder that is substantially parallel with the front surface against which a downwardly depending projection may abuttingly engage; and a substantially planar third section, the first section, the second section and the third section being substantially solid and uninterrupted by holes, recesses, or grooves; and with the bottom surface comprising at least one downwardly depending projection configured and arranged such that when a portion of one of the side surfaces is engaged with a corresponding portion of the side surface of a laterally adjacent block in a multiple course wall structure, the projection abuttingly engages a rear facing shoulder of a vertically adjacent block.

9. The retaining wall block of claim 8, further comprising a core hole extending from the top surface to the bottom surface.

10. The retaining wall block of claim 8 in combination with an earth anchor.

11. The retaining wall block of claim 8, wherein the front surface has a width in the range of about 18 to 36 inches.

12. The retaining wall block of claim 8, wherein the block has a weight in the range of about 18 to 150 pounds.

13. The regaining wall block of claim 8, wherein the front surface has a width in the range of about 18 to 36 inches and wherein the front surface and the rear surface define a block depth dimension therebetween, and wherein the block depth dimension is in the range of about 4 to 12 inches.

14. The retaining wall block of claim 8, wherein the lateral extent of the rear surface is approximately two-thirds or less than the lateral extent of the front surface.

15. A retaining wall block comprising:

a front portion with a generally trapezoidal shape when viewed from the top and having a front side presenting a block front surface, a back side, a top surface, a bottom surface, and a pair of rearwardly converging sides; and a tail portion extending from the back side of the front portion, the tail portion having a rear side presenting a block rear surface, a top surface, a bottom surface, and a pair of opposing side surfaces, the side surface substantially solid and uninterrupted by holes, recesses, or grooves, wherein the opposing side surfaces extend rearwardly from the back side of the front portion, each of the opposing side surfaces spaced inwardly from a separate one of the rearwardly converging sides of the front portion so as to define a pair of rearwardly facing shoulder surfaces on the back side of the front portion on either side of the tail portion that are substantially parallel with the front surface, wherein the opposing side surfaces do not diverge as they extend rearwardly from the back side of the front portion, the top surface of the front portion and the top surface of the rear portion together defining a block top surface, the bottom surface of the front portion and the bottom surface of the rear portion together defining a block bottom surface, the block bottom surface comprising at least one projection configured and arranged such that when the front portion is engaged with a front portion of a laterally adjacent block in a multiple course wall structure, the projection abuttingly engages a shoulder surface of a vertically adjacent block.

16. The retaining wall block of claim 15, further comprising a core hole extending from the top surface to the bottom surface.

17. The retaining wall block of claim 15, wherein the opposing side surfaces of the tail portion are generally parallel.

18. The retaining wall block of claim 15, wherein the block front surface is generally planar.

19. The retaining wall block of claim 15 in combination with an earth anchor.

20. The retaining wall block of claim 15, wherein the block has a weight in the range of about 18 to 150 pounds.

* * * * *